United States Patent [19]

Fortner

[11] Patent Number: 4,948,156

[45] Date of Patent: Aug. 14, 1990

[54] STANDING LIFT AND SUPPORT FOR WHEELCHAIR USER

[75] Inventor: Glenn D. Fortner, Durango, Colo.

[73] Assignee: Legg-On, Wichita, Kans.

[21] Appl. No.: 323,566

[22] Filed: Mar. 13, 1989

[51] Int. Cl.[5] ..... A61G 7/14

[52] U.S. Cl. ..... 280/304.1; 5/81 R; 5/81 B; 5/83; 5/86; 5/88; 180/907; 272/70.3; 272/7.04; 297/5; 297/DIG. 4; 414/921

[58] Field of Search ..... 280/304.1, 250.1; 180/907; 297/5, DIG. 4; 414/921; 272/70.3, 70.4; 5/88, 86, 89, 83, 81 B, 81 R

[56] References Cited

U.S. PATENT DOCUMENTS

| | | | |
|---|---|---|---|
| 2,108,066 | 2/1938 | Kuhlemann | 244/151 R |
| 2,539,346 | 1/1951 | Feist | 5/86 |
| 2,572,149 | 10/1951 | Hind et al. | 280/290 |
| 2,596,055 | 5/1952 | Thomas | 280/304.1 |
| 2,636,188 | 4/1953 | Lockey | 5/88 |
| 2,793,768 | 5/1957 | Schaedler | 414/541 |
| 2,991,485 | 7/1961 | Schulte | 5/81 R |
| 3,023,048 | 2/1962 | Barton | 297/330 |
| 3,107,105 | 10/1963 | Heriford | 280/211 |
| 3,137,869 | 6/1964 | Johnson | 5/86 |
| 3,189,345 | 6/1965 | Simpson | 272/70.4 |
| 3,261,031 | 7/1966 | Gates | 5/86 |
| 3,397,883 | 8/1968 | Kiehn | 272/70.3 |
| 3,398,974 | 8/1968 | Edwards et al. | 297/5 X |
| 3,405,954 | 10/1968 | Wolfe | 280/304.1 |
| 3,596,298 | 8/1971 | Durst, Jr. | 5/81 R |
| 3,629,880 | 12/1971 | van Rhym | 5/86 |
| 3,709,556 | 1/1973 | Allard et al. | 297/188 |
| 3,757,893 | 9/1973 | Hobbs | 182/6 |
| 3,787,089 | 1/1974 | Wrethander | 297/118 |
| 3,807,795 | 4/1974 | Weant et al. | 297/330 |
| 3,851,917 | 12/1974 | Horstmann et al. | 297/345 |
| 3,964,786 | 6/1976 | Mashuda | 297/330 |
| 3,999,778 | 12/1976 | Markiel | 297/5 X |
| 4,054,319 | 10/1977 | Fogg, Jr. et al. | 297/466 |
| 4,076,304 | 2/1978 | Deucher | 297/45 |
| 4,141,094 | 2/1979 | Ferguson et al. | 5/81 R |
| 4,157,593 | 6/1979 | Kristensson | 5/81 R |
| 4,249,774 | 2/1981 | Andreasson | 297/311 |
| 4,390,076 | 6/1983 | Wier et al. | 180/11 |
| 4,506,930 | 3/1985 | Lambert | 297/423 |
| 4,569,094 | 2/1986 | Hart et al. | 5/81 R |
| 4,598,944 | 7/1986 | Meyer et al. | 297/183 |
| 4,623,194 | 11/1986 | Pillot | 297/316 |
| 4,682,377 | 7/1987 | Reich | 5/86 |
| 4,739,526 | 4/1988 | Hollick | 5/86 R X |
| 4,744,578 | 5/1988 | Stearns | 280/242 |

FOREIGN PATENT DOCUMENTS

| | | | |
|---|---|---|---|
| 2560766 | 9/1985 | France | 272/70.4 |
| 1810 | of 1915 | United Kingdom | 5/81 R |
| 1407033 | 9/1975 | United Kingdom . | |

OTHER PUBLICATIONS

"Riser" Chair, Imex Medical, Inc. Promotional Literature.

Stand Aid of Iowa, Inc. Promotional Literature.

Dr. Blatter+Co. German Promotional Literature.

"Gran-Stan" Promotional Literature.

"Independent" Advanced Technology Corp. Promotional Literature.

"Stretchchair" MLA Mobilizer Promotional Literature.

Craig Hospital Stall Bar (procedure).

*Primary Examiner*—Mitchell J. Hill

*Attorney, Agent, or Firm*—Kenton L. Freudenberg; Maxwell C. Freudenberg

[57] ABSTRACT

A simple, lightweight, easily assemblable, disassemblable and transportable frame and motive means which can be attached to a wheelchair to enable a user having a lower body disability to safely move to and from a standing position without assistance from another person. The device provides braces against horizontal movement of the user's knees and hips when standing to allow the individual's skeletal structure to support the majority of the individual's body weight. The device utilizes a manually operated worm gear mechanism to provide a mechanical advantage in lifting and security against undesirable reverse movement of the lifting means when under load.

21 Claims, 6 Drawing Sheets

Fig. 5
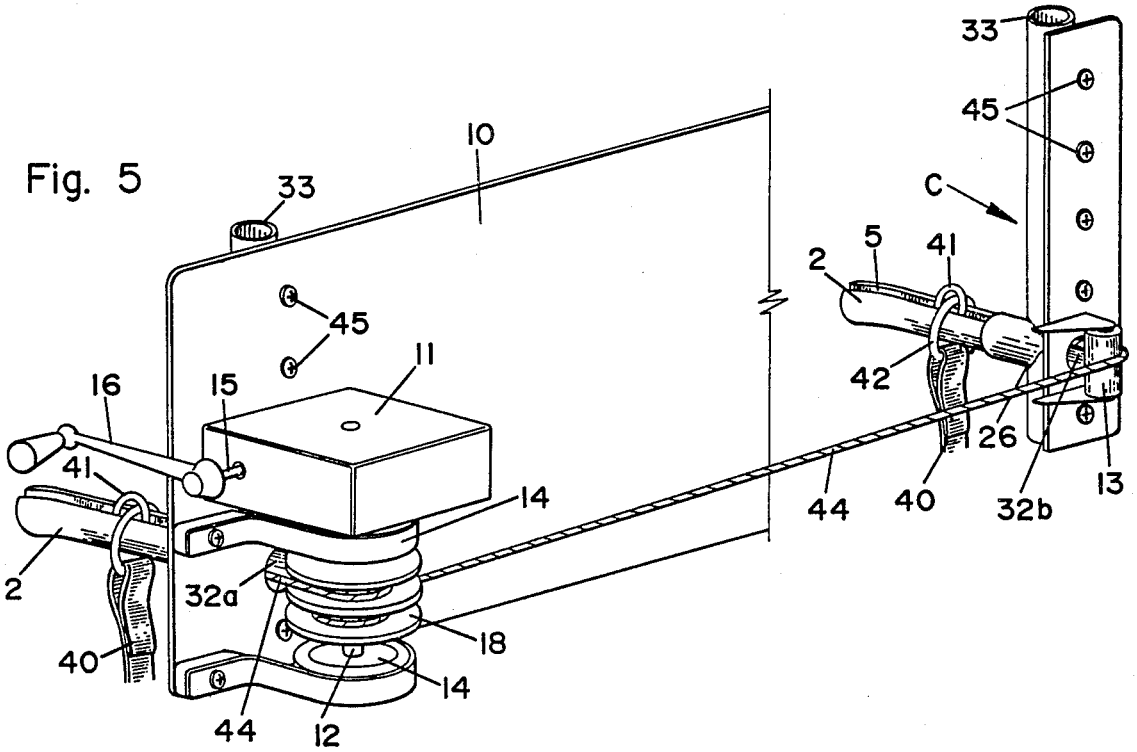
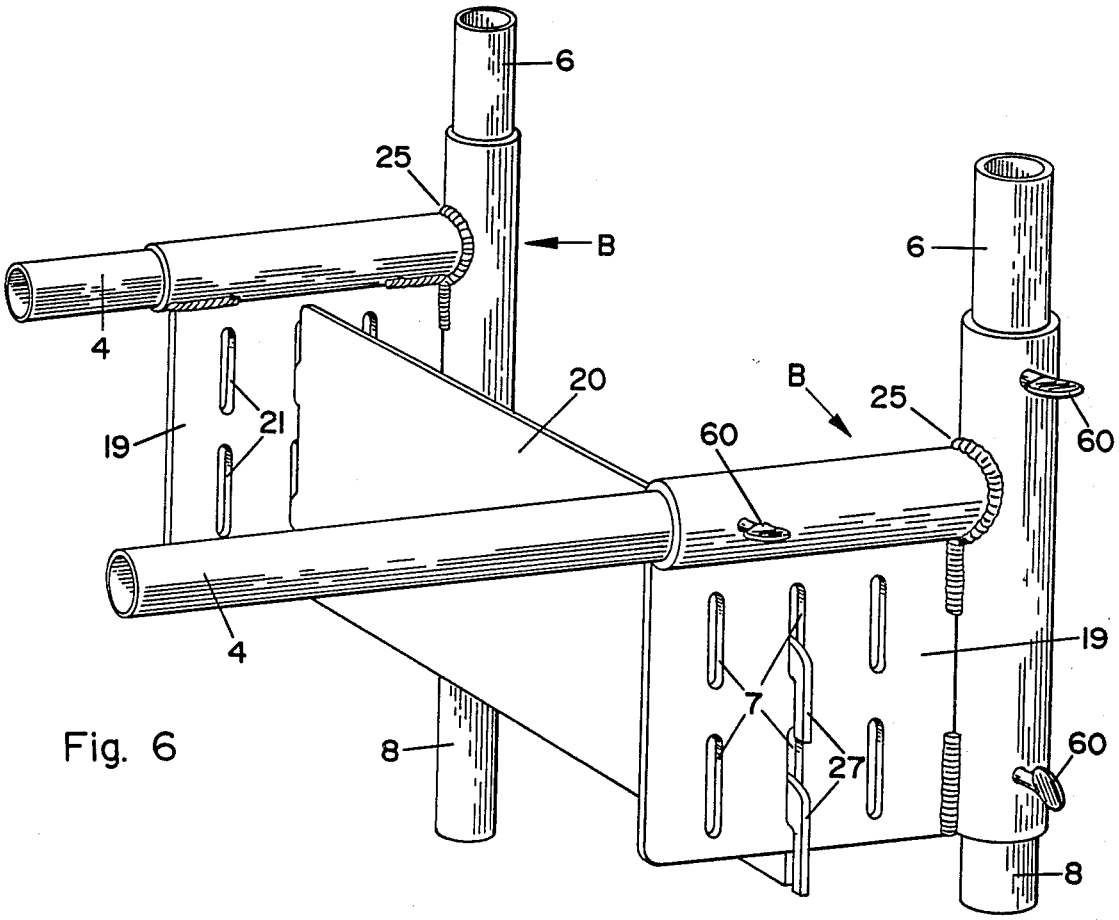
Fig. 6

STANDING LIFT AND SUPPORT FOR WHEELCHAIR USER

BACKGROUND OF THE INVENTION

A wide variety of prior art devices have been designed to assist wheel chair users in achieving a standing position from a sitting position. Such devices have ranged from simple hand rails, which require the user to lift most of his or her body weight without mechanical assistance, to fully mechanized devices which perform the lifting and support functions almost completely independently of the user of the device. The present invention is intended to provide a dependable, mechanically simple device to enable even persons with a full lower body disability to easily and safely move themselves between sitting and standing positions while utilizing their own skeletal structure for support.

SUMMARY OF THE INVENTION

The present invention relates to an easily assemblable, disassemblable and transportable frame which can be attached to a wheelchair to enable the user to safely move to and from a standing position without assistance from another person. Where much of the prior art involves devices which are a permanent part of the wheel chain and are mechanically complicated and expensive to construct, the present device is intended to provide an inexpensive, lightweight and portable system with a collapsible or disassemblable frame which includes a seat support which may be user operated and activated to bring the user to a partially braced anatomically balanced upright position. The therapeutic benefits, both physical and psychological of allowing an individual with limited or no use of the lower body and legs to achieve a standing position supported by the person's own skeletal structure are well recognized. The physical benefits include:

1. Improved bowel and bladder regularity;
2. Reduced urinary calculi;
3. Strengthening the cardiovascular system;
4. Aid in adjustment of orthostatic hypotension;
5. A reduction of edema in lower extremities;
6. Aid in keeping lungs clear;
7. Improved digestive metabolic process;
8. Reduced risk of decubiti;
9. Lessening of muscle spasms and contractions;
10. Stretching of tendons and ligaments in lower extremities, and;
11. Reduced calcium loss in bones.

In prior art devices where means have been provided to assist a wheelchair user to a standing position, those means have typically provided total support of the body weight so as to negate any need for support of the user's weight by their own skeletal structure. Even in those devices which have required some degree of skeletal support, the positioning of the users body is often far from being in a naturally balanced or anatomically correct stance. At the other extreme are prior art devices such as hand rails which would enable a person to stand by using their own upper body strength. Use of such a device to achieve a standing position requires a relatively high degree of upper body strength and does not provide for continued support in the standing position. While standing with such a device the user's hands and arms are not free to be used for any other purpose. In contrast to these extremes, the standing frame of the present invention provides a means for a wheelchair user to stand and be supported without any assistance, but without artificially supporting the individual's body weight and without requiring weight to be continuously borne by the user's upper body, arms and hands. This is achieved by using supporting means whose primary support is provided by preventing horizontal motion of the user's feet and the knee and hip joints when the user is standing in an anatomically balanced position. By preventing the unbraced movement of skeletal joints at these locations the weight of the user is supported nearly entrely by the individual's skeletal structure. This allows the device itself to be simpler and lighter since its purpose becomes one of stabilization more than that of complete support once the user has achieved a standing position.

The present invention uses a frame, attached to the wheelchair and resting in part on the ground surface, with side frame rails to provide parallel arced tracks along which a seat harness assembly slides as it is moved upwardly and forwardly by a simple manually operated mechanism between a lower seated position and a raised standing position. By shaping the rails in an arced shape, this movement closely approximates the natural movement of the hips and allows the user's skeleton to provide increasing support of body weight during the movement from sitting to standing.

The seat harness assembly is a simple flexible assembly comprising a waist band of relatively broad webbing to which are attached additional loops of narrower webbing which pass around the user's legs. The waist and leg loops are disengageable to allow the harness to be put on by the user while in a seated position.

The actuating mechanism is a simple manual worm gear drive comprising a worm driving a worm wheel fixed to a rotatable output shaft. This structure provides the benefit of a worm gear's one-way or self-holding action, i.e., the drive mechanism provides a sufficient mechanical advantage to allow the worm shaft to be easily manually rotated under load to provide the necessary lifting force, but cannot itself be reversed by a load applied to the output shaft. This provides the security of allowing the user to be supported at any point in the arc of the lifting motion without having to rely on any separate braking means. The seat harness is supported at each side on the arced tracks and is moved therealong by one of two tension cords which slides within each arced track. The harness is raised and moved forwardly along the tracks as the cords are pulled within the tracks. The harness is caused to be lowered downwardly and rearwardly along the tracks by the weight of the user as the cords are unwound by the actuating mechanism. Each cord is secured at one end to a ring which supports the harness and which slide upon a respective arced track. At its opposite end, each tension cord is fixed to one of two separate spools mounted together upon the rotatable output shaft of the drive mechanism. Each spool serves as a guide for its tension cord as it is wound in and out by the rotation of the spool. Both spools are identical in size and are keyed or fixed together so that rotation of the shaft either takes up or lets out an equal length of each cord and each side of the harness assembly is raised or lowered by an identical amount when the drive assembly is operated.

The drive mechanism is mounted to a main front brace and support plate which serves the functions of (1) providing transverse stability of the entire frame structure and (2) providing a forward brace against which the hips of a user are horizontally braced when standing. Below this front brace and support plate is another transverse plate which is located at or just below knee level. Because the normal articulating movement of the knee joint allows it to move only forward relative to the body there is no need for a rear support at the same location. The user's feet are also secured against movement by webbing passing behind the heels and over the front of the feet. Such securement is necessary primarily during intermediate movement between standing and sitting positions using the device. During these movements, some of the weight of the user is borne by the harness. However, in the full standing position the feet will tend to hold their position solely because of friction created by the user's weight which is borne nearly entirely by the feet.

The output shaft is used to wind and unwind a sturydy flexible cord which is guided longitudinally within the tubular arced side frame members. By supporting a seat harness directly on these arced support rails with the movable support cord passing along and within the tubular channel, all forces to move the harness assembly are applied essentially tangentially at the inner tubular surface along the arc of the rails and slide the harness supports easily therealong. While the arc described by the rails of the present invention is generally that defined by the movement of a user's hips about the knee joint, the use of an arced surface to define the path of travel of the seat harness avoids the need to have a mechanical arms or the like extending from a pivot axis. The use of this simple mechanism avoids any need for cantilevered support of the weight of a user and the resultant cumbersome structure required to accomplish such support, and also avoids the heavier drive mechanism required to operate such a structure. This invention allows further simplification of the structure, since such a pivot structure, if used, could only be located along a line passing through both knee joints. The use of a pivoting lever system such as that known in the prior art also results in having exposed movable frame parts. In contrast, the only moving parts of the present invention near the user's body are the harness itself and the cords to which it is attached. Since none of the frame components of the present invention near the user's body are required to move and the cords used to slide the harness along the rails are not exposed, there is little or no potential of clothing, body parts or other objects being caught in or interfering with the movement of movable parts. This further enhances the ease of use and the safety of the device when it is used by an unassisted individual. By simplifying the structure of the device a more aesthetic visual appearance is also provided.

A very significant feature of this device is that it is assembled from several simple parts which are small, light weight and suitable for storage in a small package for convenient handling, particularly when transporting it with a folded wheelchair from one location to another. The compactness also allows the disassembled device to be kept on hand at all times when the wheel chair is in use, by for instance being stored beneath the seat portion of the chair. The simplicity and light weight of the device allow it to be manually assembled and attached to the wheelchair by the wheel chair user without requiring any tools or assistance from another individual.

Because of the simplicity of the device described herein and the fact that its operating mechanisms are essentially independent of the wheelchair to which it is attached, it can be readily adapted for attachment to nearly any normal wheelchair. Additionally, the device can be operated independently of a wheelchair through the use of simple modifications described in greater detail below.

It is an object of the present invention to provide a manually operable device to enable a wheelchair user to rise to a standing position unassisted.

It is another object of the invention to provide a device which is sufficiently simple, light and portable to be capable of being transported, put into place, operated and disassembled by the wheelchair user without any tools or other assistance.

A further object of the invention to provide a standing-assist device which enables a wheelchair user to stand supported primarily by the user's own skeletal structure.

It is an object of the present invention to provide a device to allow a wheelchair user to rise to a standing position unassisted by another person and in which exposed moving parts are minimized.

An additional object of the present invention is to provide a mechanically simple and dependable standing-assist device for a wheelchair user to enable the user to rise to a standing position unassisted.

Another object of the present invention to utilize a simple standing-assist device for an otherwise unassisted wheelchair user to provide body movement in rising to a standing position, which movement approximates the natural movements of the joints of the user's body.

It is also an object of the invention to provide a standing-assist device which is attachable to nearly any wheelchair but which can also be used independently of a wheelchair.

DESCRIPTION OF THE DRAWINGS

FIG. 5 is a cutaway view of the main front plate of the device without padding showing detail of the drive assembly and tension cords.

FIG. 6 is a perspective view showing detail of the adjustable knee brace without padding.

DESCRIPTION OF THE PREFERRED EMBODIMENT

Figure 1:
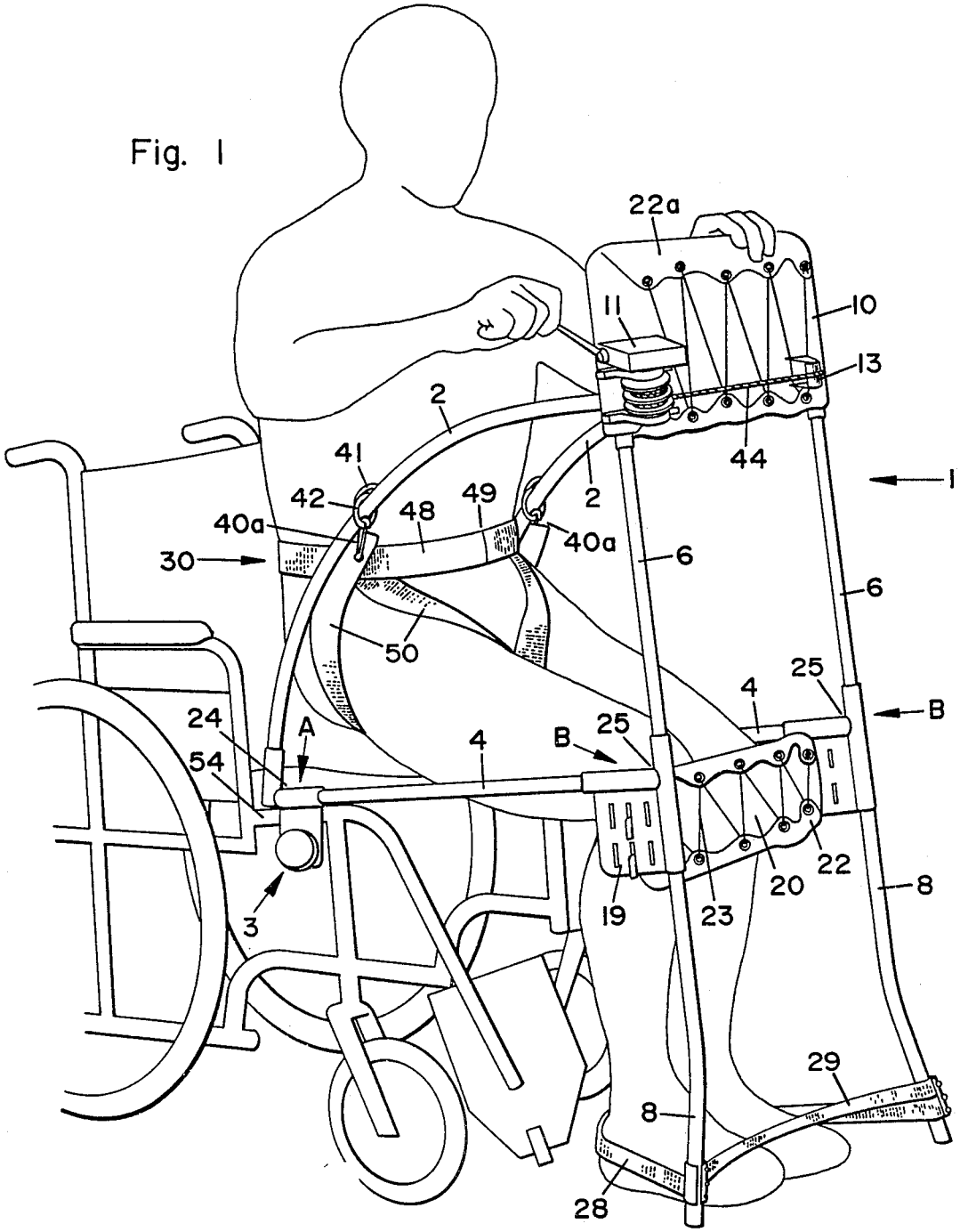
FIG. 1 is a perspective view of the standing-assist device of the present invention attached to a conventional wheelchair and showing a user partially raised from a sitting position toward an erect standing position.
Figure 2:
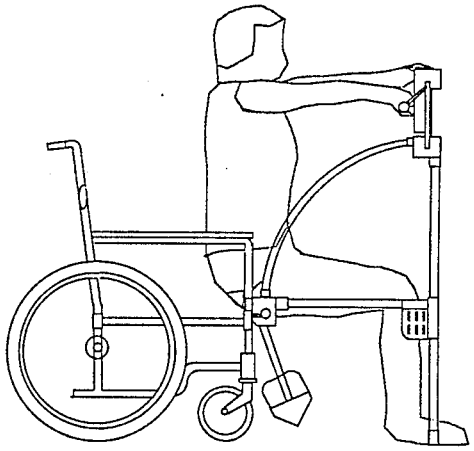
FIGS. 2 through 4 are side views showing the device of FIG. 1 being operated through its full range of motion with the user in sitting, partially erect and erect standing positions, respectively.
Figure 3:
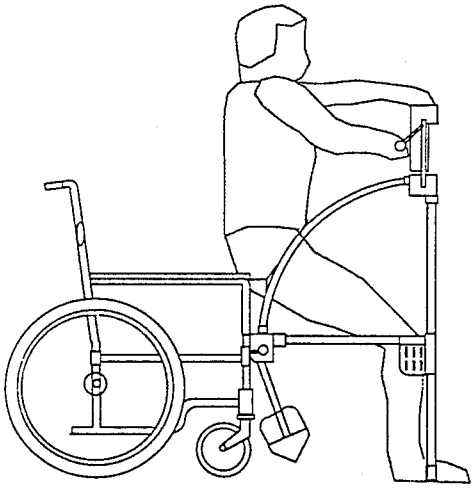

In accordance with the present invention the standing-assist wheelchair attachment device comprises two simple rigid three-sided and three-cornered side frame structures 1, one on each side of the wheelchair occupant as shown in FIG. 1. These side frame structures each have an arcuate tubular track 2 at their upper sides and are rigidly interconnected to each other by means of attachments to the wheelchair at their lower rear corners 24 and by means of two transverse person-supporting braces 10 and 20 interconnecting the upper front corners and the lower front corners, respectively. These side frame structures 1 are further supported with respect to the supporting surface on which the wheelchair rests by means of two legs 8 rigidly connected to and depending from the lower front corners 25 of the side frame structures.

The three sides of the essentially planar side frame structure 1 are single tubular members. One side is a bottom horizontal tubular bar or rail 4 extending forwardly from a first corner 24 at the lower rear of the structure to a second corner 25 near the knees of the person when standing. A second side is formed by the arcuate track bar 2 which curves upwardly and forwardly from the first corner, in an arc having a center at approximately the second corner 25, to a third corner 26 above corner 25. The arc corresponds generally to the path of the person's hips in moving from a sitting position in the wheelchair to the standing position against the hip and knee braces 10 and 20. The third side is formed by a tubular bar or rail 6 which extends vertically from the second corner 25 to the third corner 26 where it is connected to the arcuate track bar 2.

The person is assisted to the standing position and held against the main front support brace plate 10 and knee brace plate 20 by means of a body and seat harness 30 supporting the person in the area of the hips. The side of knee brace plate 20 facing the user is wrapped with padding 22, which is securely held in place by lacing 23, and located to brace the front of the knees when the person is standing. The face of the padding 22 toward the user is preferably generally contoured to the shape of a user's legs by incorporating two generally vertical parallel depressions which accommodate a user's shins and/or knees and help prevent any sideways movement of the user's leg. The front brace 10, also having similarly laced but flat padding 22*a*, is located from hip to waist height to brace the front of the user when standing.

As shown in FIG. 1 the harness 30 has leg-encircling supporting straps or loops 50 secured thereto at opposite sides. The harness 30 is secured to small rings 42 which encircle and slide along the top arcuate rails or tracks 2 of the three-sided frame structures 1. The arcuate tubular tracks 2 each have a longitudinal slot 5 along the top surface so that track 2 forms a channel. Each track encircling ring 42 is moved longitudinally of its track by means of a longitudinally slidable track follower ring 41 having a D-shaped portion projecting outwardly through the slot and engaging the track encircling ring 42. Each track follower ring 41 is pulled along and within the track by means of one end of a flexible tension cord member 44 secured thereto with the other end wound on a rotatable winding mechanism 11 carried by the front brace plate 10 as described in detail hereinafter in connection with FIG. 5. and driven by a manually operated motive mechanism. While a manually operated motive mechanism is desirable for the sake of dependability, simplicity and low cost, an electrically powered or other similar powered mechanism under control of the user could be substituted without departing from the spirit of the invention as described herein.

Figure 10:
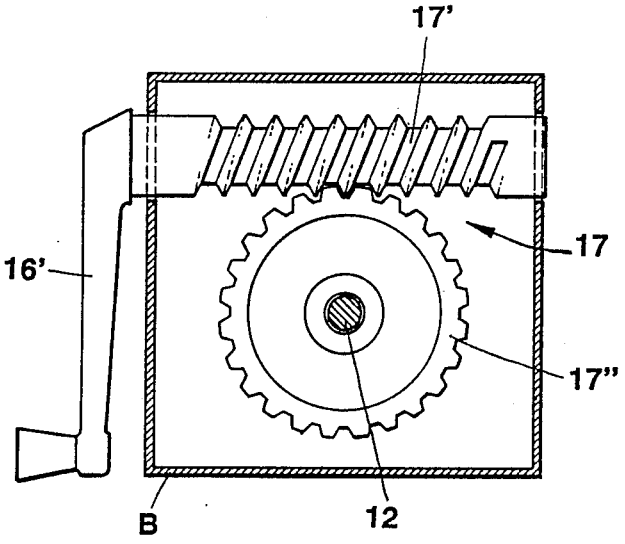
FIG. 10 illustrates a worm gear which may be used in the box of the driving mechanism of FIG. 5.

The operating winding and motive mechanism 11 of the device is mounted on plate 10 on the front side thereof. This mechanism comprises a box B located on the right front side of the plate and containing a self-holding worm gear 17. The worm is driven by a horizontal shaft 15 and drives a worm wheel connected to a vertical axle 12 journalled in suitable bearings 14 near opposite ends of the axle. The worm gear is operated by a manual crank 16 on the outer end of the shaft 15. The worm gear 17 within box B may be as shown in FIG. 10 wherein the worm 17' may be rotated in either direction by the crank arm 16' to drive the worm wheel 17'' which in turn is appropriately keyed to the vertical axle 12. The crank arm 16 is about the same size as a typical automotive window crankarm and operates about a horizontal axis in a vertical circle just beyond the right edge of the plate 10. Fixed to the axle 12 and rotating about its axis is a spool assembly 18 comprising two spools, one above the other, which rotate with the axle to take up and let out the tension cord members 44 to effect, respectively, the raising and lowering of the user in the harness 30. The inner walls of each spool taper toward each other at the axis of the spool to insure consistency in winding and unwinding of the tension cords 44 with each succeeding wrap overlying preceding wraps.

Figure 7:
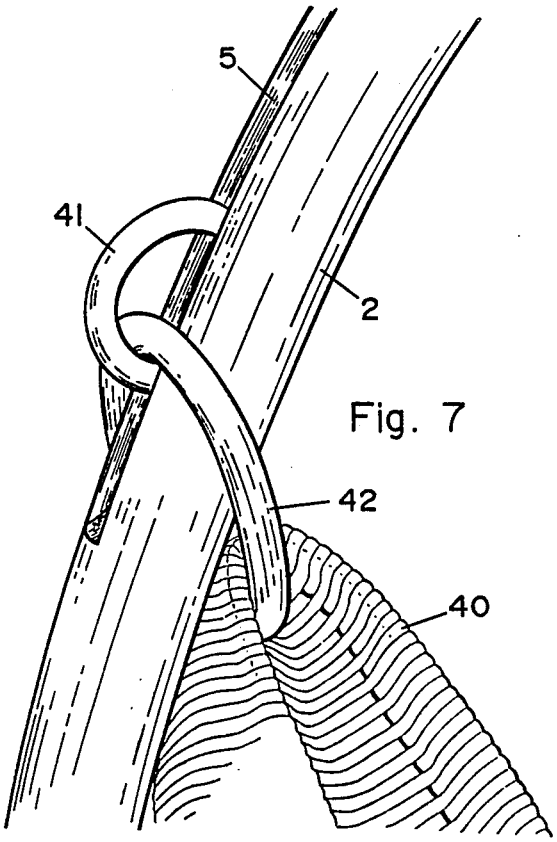
FIG. 7 shows detail of a portion of an arcuate side track and an associated track follower means with webbing of a seat harness attached to the track follower means.
Figure 8:
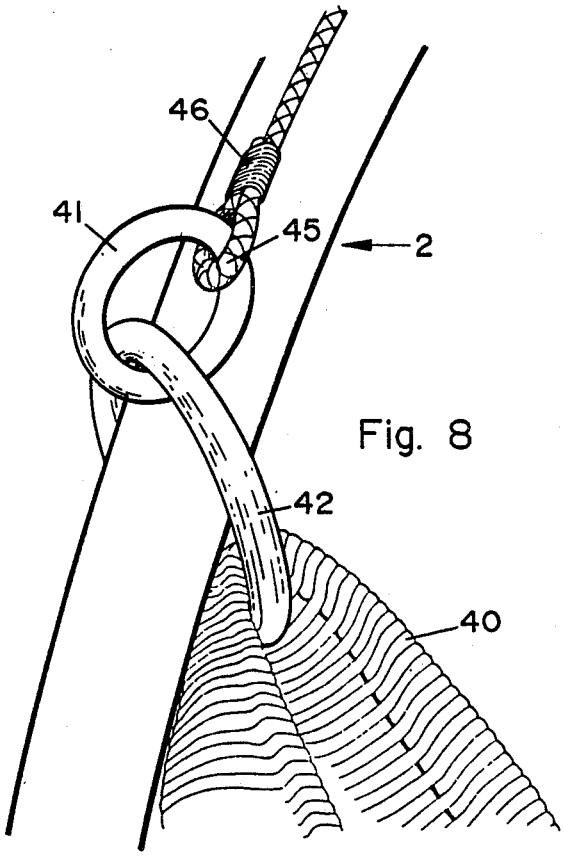
FIG. 8 is a cutaway view of FIG. 7 showing a flexible actuating cord within the tubular arcuate side track.

The body and seat harness assembly 30 shown in FIG. 1 comprises a waistband 48 of nylon webbing material approximately 2 inches in width, and adjustable in length to the waist size of the user by means of overlapping ends which are fastened together with a hook and loop fastener 49 at the front of the wearer. In lieu of passing the supporting loop straps 40, which are attached at sides of the waistband 48, through the rings 42 as shown in FIGS. 7 and 8, a detachable hook means 40*a* may be used to support the waist band from the rings 42 as shown in FIG. 1. The hook means 40*a* are permanently affixed at each side of the waist band for detachably connecting the harness 30 to each of the track encircling rings 42. The two leg loops 50 of the harness 30 are of webbing similar to that of the waist band but slightly narrower in width, each loop having one end permanently sewn to the waist band at a point slightly to the rear of the point of attachment of the hook means. The free end of each leg loop is provided with an aperture by which the end of the loop can be secured by slipping the aperture over the entire hook means after the leg loop is passed around a leg and before the hook means is fastened to the track encircling ring. Alternatively, the loops 50 may have any suitable strong comfortable separable fasteners to facilitate placing them around the legs of the user.

The entire standing-assist device is made stable with respect to front to rear movement by simple corner connectors A, B and C which make rigid the three-sided side frames, each connector having generally perpendicular oriented tubular sockets which receive respective end portions of the three tubular side members 2, 4, and 6. Additional stability is provided by rigid connection of the connector A to the wheelchair as shown and described hereinafter in connection with FIG. 9 and by the legs 8 which rest on the wheelchair supporting surface.

The connector B at the second corner 25 has an additional socket for receiving the upper end of a leg 8. Connectors C at the corners 26 at the upper front of the side frames are rigidly fixed to opposite ends of the main brace plate 10.

The entire standing-assist device is made stable with respect to lateral movement by means of the main brace 10 and the knee brace 20 which are rigidly connected to the corner connectors B and C, respectively, by the rigid connection of the corner connectors A to the wheelchair, and by the rigidly connected legs 8 which have non-skid feet resting on the floor or other wheelchair supporting surface.

The lower right angle of connector B formed between the sockets therein for the adjacent ends of tube 6 and leg 8 is gussetted with a square aluminum plate 19 which is an integral part of connector B. Plate 19 has plurality of horizontally spaced parallel pairs of vertical slots 21 into which can be securely and rigidly affixed the generally hook shaped extensions 27 on the laterally outer ends of the plate 20 against which the users knees or shins are to be immobilized. The spacing of these slots permits front to rear adjustment of the knee brace when assembling the device. Secured to the bottom of the vertical support legs 8 and extending therebetween are two straps. The first such strap is a two piece strap 28 comprising overlapping strap portions held together by hook and loop fasteners which provide for adjustability of the length of the strap. Strap 28 passes behind the user's feet to hold them against rearward movement relative to the wheelchair or to the standing-assist device. The second such strap 29 passes over the top and in front of the user's feet to secure them against upward or forward movement.

Figure 4:
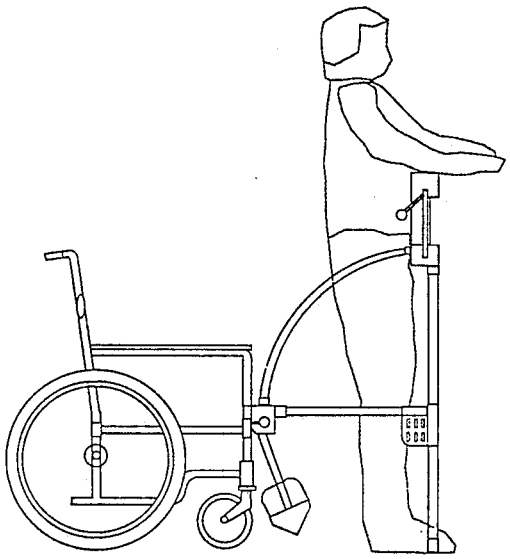

Although the corner connectors A and B are separate structures, the corner connectors C are made integrally with the waist brace 10. The structure of this brace 10 includes a vertical flat 16 inch wide by 7.25 inch high plate of aluminum approximately ⅛ inch thick. The sockets for the upper ends of the bars 2 and 6 are tubular pieces welded together and securely attached by screws 45 to the rear of the plate 10 near the opposite ends thereof. The height of this plate and the rigid connection to the vertical bars 6 of the frame structure is sufficient to make the entire structure transversely steady. The plate 10 also serves as a support against which the stomach or hips of an individual are braced when the individual is standing and is supported by the device as shown in FIG. 4. By providing additional means such as a strap attached to the side ends of plate 10 and passing around the body at or slightly below chest level, an individual with limited use of abdominal muscles can also be stabilized against the plate to prevent uncontrolled rearward movement of the upper body. This additional bracing may be further facilitated by increasing the height of the plate. The plate further provides a possible support for mounting a tray or shelf in front of a standing person and at a readily accessible height. Any such tray or shelf is preferably made of a transparent material, such as clear acrylic plastic, to enable the user of the device to be capable of viewing the operating mechanism of the device as well his or her feet. The latter may be desirable to allow any discloration or other physical abnormality to be determined visually, particularly in an individual who, because of damage to the nervous system, may have limited or no sensation in portions or all of the lower extremities. The open upper end 33 of each connector C can also be used to receive any accessories, including upwardly extending vertical tubular frame extensions, additional front brace plate members attached thereto or other structures for the purpose of providing additional bracing to the upper body of an individual with limited abdominal control.

The forward open ends 32*a* and 32*b* of the arcuate tubular track members pass through the sockets of the respective connectors C on the plate 10 and penetrate the latter to a point generally flush with the forward face of the plate. The end 32*a* of the first tubular member, on the same (right) side of front plate 10 as the drive mechanism, is horizontally positioned slightly outboard of the centerline of axle 12. The centerline of the forward open end of this arcuate track member is in vertical alignment with the hub of the upper of the two spools so that the cord therefrom is guided into the open end 32*a*. At the opposite (left) side of the front plate away from the drive mechanism a small roller or pulley wheel 13 on a vertical axis is positioned in front of, and slightly inboard from, the open end 32*b* of the second tubular track member to guide the cord tension member to pass unimpeded from the tubular member 2 around the roller 13 and across the front face of plate 10 to the lower spool of the previously described spool assembly 18.

Each spool is sufficiently narrow between walls so that the tension cord 44 from the upper spool remains aligned with the end of tubular member 2 which it passes through directly behind this spool and the other cord from the lower spool remains essentially horizontal in passing over to the roller 13 and therearound into the open end of the other tubular member.

If desired, the winding mechanism can be rearranged on plate 10 to have the worm shaft extending vertically from the gear box and the crank operating in a horizontal circle above the plate 10, but sufficiently toward one end thereof or in front thereof so that it can be operated while the user's body is against the plate. In this case the output shaft may be lengthened to extend horizontally between bearings therefor near opposite ends of the plate and with the spools keyed to the shaft and aligned with the respective open ends of the tubular track members 2.

The tension cord members 44 are of any suitable cord material which is flexible without being subject to lengthwise stretching under load and which provides sufficient tensile strength to accomplish the purpose of lifting the weight of a user of the invention. Such a suitable construction is found in readily available "kern-mantle" cord of a nominal outside diameter of 5 millimeters and comprising a core of aramid fibers sheathed in a woven protective cover of nylon fiber. The tension cord members are permanently fixed to the track follower ring 41 by forming a loop 45 in the end of the cord member which passes through the ring 41 and by binding the free end of the cord member back onto a portion of the cord member using a relatively fine thread or line as shown at 46 in FIG. 8. The bound portion is then saturated with a resin such as epoxy which will harden to further secure the loop at the end of the cord and which will provide a relatively smooth coating to slide easily within the arcuate tubular member and be resistant to abrasion during such movement. The other ends of the cords are suitably secured to the hub portions within the winding spools of the drive mechanism, for example, by a small loop at the end of the cord placed over a small radial pin or hook on the spool hub.

Although most of the parts of this device are made of aluminum to keep the device light in weight, the arcuate track bars 2 and the parts which slide thereon are preferably made of stainless steel for greater wear resistance. The weight of entire standing frame of the preferred embodiment as shown and described herein does not exceed ten pounds, exclusive of the weight of the wheelchair and the parts which remain permanently attached thereto when the frame is detached from the wheelchair.

When different sizes of standing assist devices are required, they can easily be made merely by using different lengths and shapes of the tubes 2, 4, 6, and 8.

Figure 9:
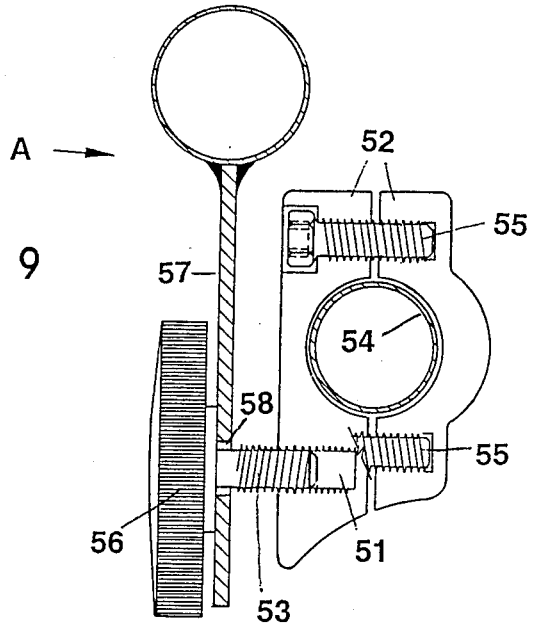
FIG. 9 is shows cross sectional detail of a clamp secured to a bar of a wheelchair and a releasable attachment portion of the standing-assist device, prior to the attachment being fully tightened into place against the clamp, to secure one side of the device to the wheelchair.

The ends of the several tubular members fit closely in the respective sockets of the corner connectors A, B and C and may be securely and rigidly anchored therein by manually tightenable set screws 60 on each such connector. To further facilitate tightening by hand, these set screws could also be constructed with enlarged heads similar to the means used for attaching the standing frame to a wheel chair as shown in FIG. 9 at 56. The slots 5 in the track bars stop short of the end portions of the bars which enter the sockets to assure strength where the bars are secured by the set screws. Any other means allowing for detachable manual securement of the frame members to one another could be readily substituted for the connectors and set screws as described.

The device of the preferred embodiment is made securely attachable to and readily detachable from a wheelchair by manual means without the use of additional tools through use of the connector means shown in FIG. 9. The connector A at the first corner 24, in addition to the sockets for the ends of the arcuate and bottom rails, has means for rigidly attaching it to the wheelchair frame at a point near the side of the seat thereof. Mounted on each of the generally horizontal seat supporting tubular members 54 of a typical wheelchair is a two part clamp means 52 which is rigidly secured to the tubular member 54 by tightening of threaded screws 55 which pull the clamp portions into tight engagement around the tubular member. The outer face of the clamp means is provided with a female threaded hole 51 into which a shouldered manually operated male threaded connector 53 can be engaged. A lower portion of corner connector A of the side frame comprises a vertical aluminum plate 57 provided with an aperture 58 through which the male connector 53 passes. As the male connector is tightened into hole 51 the inner face of plate 57 is drawn tight against the outer face of the clamp means 52 and the standing frame is securely and rigidly connected to the wheelchair. In the preferred embodiment such male connector comprises ordinary machine threads fitted with a relatively large knob or head 56 of, for example, a diameter of 2 inches, which is textured or knurled around its periphery so as to provide a secure grip when being operated manually. The connectors A and the knobbed threaded members are located to the outside of the clamp means 52, which can be left permanently in place on the wheelchair when the standing assist device is detached therefrom.

While the standing frame of the present device is primarily intended to be used by being attached to a wheelchair, it is also suitable for fixed mounting to, for example, a table at which a wheelchair user desired to work in a standing position. In such case the front of the standing frame as described would be anchored to or braced against such table. Connector A would be constructed to be similar to connector B with an additional third socket, opening vertically downward, which would accept additional tubular vertical extensions similar to legs 8 but which would be located at the rear of the structure, the lower leg ends also having non-skid feet which would rest on the floor or ground surface.

It must also be noted that while the present device is primarily intended for use by an unassisted individual with only a lower body disability such as a paraplegic, it is equally well suited to use by an individual with a greater degree of disability, such as a quadriplegic, with the assistance of another.

Other variations within the scope of this invention will be apparent from the described embodiment and it is intended that the present descriptions be illustrative of the inventive features encompassed by the appended claims.

What is claimed is:

1. A device for assisting a person in moving to and from a standing position comprising a harness means for at least partially supporting the torso of the person during the movement, a frame including arcuate track means at each side of the person for supporting and guiding the path of said harness means during such movement, track follower means supported by and movable along each of said arcuate track means, motive means carried by said frame and connected to said track follower means for moving the track follower means along said track means, means for connecting said harness means to said track follower means at each side of the person whereby the movement of said track follower means along said arcuate track means raises and lowers said harness in a corresponding arcuate path.

2. A device according to claim 1 wherein the arcuate track means at each side of the person comprises a channel shaped member.

3. A device according to claim 1 wherein said frame includes a first horizontally extending brace for engaging the front of the person's knees and a second horizontally extending brace for engaging the front of the person at approximately waist height when in the standing position.

4. A device according to claim 1 for attachment to a wheelchair wherein said frame comprises at each side of the wheelchair a three-sided structure having as one side a generally horizontal bar extending forwardly from a first corner near the wheelchair seat to a second corner near the knees of the person, means for attaching the first corner of each structure to the wheelchair, the arcuate track means forming a second side of each said structure and extending upwardly and forwardly from said first corner to a third corner near hip height and above the second corner, the third side of said structure being a vertically extending bar extending between said second and third corners, said frame including support legs extending from said second corners to the supporting surface for the wheelchair.

5. A device according to claim 4 wherein said frame includes separable means at each said corner for manually detaching the three sides of each structure from each other.

6. A device according to claim 3 wherein said motive means is operated by a manual crank carried by said second brace.

7. A device according to claim 6 wherein said motive means is connected to the track follower means by flexible tension members, said motive means comprising means for winding and unwinding the flexible members to pull and release said track follower means along the arcuate tracks.

8. A device according to claim 7 wherein each said arcuate track means comprises a channel member, said flexible tension members moving in an arcuate path within said channel members during winding and unwinding thereof.

9. A device according to claim 1 wherein the total weight of the device does not exceed about 10 pounds.

10. A lightweight portable device for assisting a person in movement between sitting and standing positions comprising a frame at least partially supported on a surface on which the person is to stand, a support member carried by said frame extending transversely across in front of the person at waist height when the person is in the standing position, a harness for at least partially supporting the torso of the person, harness moving and supporting means carried by said frame and extending rearwardly and downwardly from said support member during such movement and including members connected to said harness at each side of the person to provide said movement, motive means carried by said frame for actuating the harness moving means, operating means on said support member and within reach of and operable by the person in both sitting and standing positions for controlling said motive means to cause said motive means to raise or lower said harness and the person therein between said positions.

11. A device according to claim 10 further comprising means for detachably connecting said frame to a wheelchair to be partially supported thereby.

12. A device according to claim 10 further comprising brace means carried by said frame to limit forward movement of the person's knees during movement to the standing position.

13. A device according to claim 12 wherein the members of said harness moving means which are connected to said harness are tension cords for moving said harness forwardly and upwardly to cause movement of the person's hips and knees through positions in which the feet remain on said surface, the knees are braced against said brace means and the skeletal portions of the person substantially contribute to the person's support during such movement.

14. A device according to claim 10 wherein the motive means is a worm gear which is self holding.

15. A lightweight portable device for assisting a person in moving to and from a standing position on a surface comprising a harness for at least partially supporting the torso of the person during the movement, means for supporting and moving said harness including: a frame supported by said surface and having an upper end, a forward brace portion carried by the frame at the upper end of the frame and against which the hips of the person are horizontally braced when the person is in a standing position, drive means including a drive member and a driven member mounted on said forward brace portion, harness raising and lowering means for connecting said harness to said driven member, said harness raising and lowering means extending downwardly and rearwardly from said forward brace portion, and means connecting said driving and driven members for providing a large mechanical advantage so that a relatively small force from the drive member will provide a larger force at said driven member whereby the harness raising and lowering means raises or lowers said harness between a lower rearward position and an upper forward position corresponding to said standing position.

16. A device according to claim 15 wherein said device includes means for removable securement to a wheelchair.

17. A device according to claim 15 wherein said drive means comprises a self-holding worm gear mechanism.

18. A device according to claim 15 wherein said drive means comprises a manually operable worm gear mechanism.

19. A device according to claim 15 including means for horizontally bracking the person's hips and knees whereby the majority of the body weight of the person is borne by the person's skeletal structure and only a small portion of the body weight is supported by said harness when the harness is in the upper forward position and the person is in the standing position.

20. A device according to claim 15 wherein the means for supporting and moving said harness comprises a tubular frame structure to at least partially rest on the said surface, said forward brace portion being carried by said tubular frame structure.

21. A device according to claim 15 wherein said device comprises a plurality of interconnected parts, including the frame, the forward brace portion, the drive means and the harness raising and lowering means, which parts are readily and sufficiently manually disassemblable and are sufficiently small and compact in their disassembled form to be collectively stored as a pack below the seat of an ordinary wheelchair.

* * * * *